US010385850B2

(12) United States Patent
Pawlik

(10) Patent No.: US 10,385,850 B2
(45) Date of Patent: Aug. 20, 2019

(54) HYDRAULIC PUMP HAVING A CYLINDRICAL ROLLER WITHIN A HOUSING HAVING AN INLET GALLERY AND AN OUTLET GALLERY FORMED IN A CIRCUMFERENTIAL OUTER SURFACE OF THE HOUSING

(71) Applicant: HS Wroclaw Sp. z o. o., Wroclaw (PL)

(72) Inventor: Robert A. Pawlik, Wroclaw (PL)

(73) Assignee: Goodrich Actuations Systems Limited, Solihull, West Midlands (GB)

( * ) Notice: Subject to any disclaimer, the term of this patent is extended or adjusted under 35 U.S.C. 154(b) by 320 days.

(21) Appl. No.: 15/198,330

(22) Filed: Jun. 30, 2016

(65) Prior Publication Data

US 2017/0009769 A1 Jan. 12, 2017

(30) Foreign Application Priority Data

Jul. 6, 2015 (EP) ..... 15461547

(51) Int. Cl.

| | |
|---|---|
| ***F04C 11/00*** | (2006.01) |
| ***F04C 15/00*** | (2006.01) |
| ***F04C 15/06*** | (2006.01) |
| ***F04C 2/356*** | (2006.01) |

(52) U.S. Cl.

CPC ..... *F04C 15/0065* (2013.01); *F04C 2/3564* (2013.01); *F04C 2/3566* (2013.01); (Continued)

(58) Field of Classification Search

CPC ..... H02K 21/12; H02K 21/01; H02K 5/1285; H02K 5/132; H02K 5/20; H02K 27/00; (Continued)

(56) References Cited

U.S. PATENT DOCUMENTS 1,341,848 A * 6/1920 Haensler ..... B25H 3/003 144/286.1
1,471,761 A * 10/1923 Weidenbach ..... F04C 2/3446 418/225

(Continued)

FOREIGN PATENT DOCUMENTS

EP 0617753 A1 10/1994
EP 1914381 A1 4/2008

(Continued)

OTHER PUBLICATIONS

European Search Report for Application No. 15461547.0-1608; dated Sep. 4, 2015; 7 pages.

*Primary Examiner* — Alexander B Comley
*Assistant Examiner* — Benjamin Doyle
(74) *Attorney, Agent, or Firm* — Cantor Colburn LLP

(57) ABSTRACT

A hydraulic pump is described comprising a rotor provided for rotation about a longitudinal axis (X-X) within a housing. The pump comprises a plurality of chambers for pumping a fluid that are provided by longitudinally extending recesses in a circumferential outer surface of the rotor. During use the recesses are moved across a circumferential inner surface of the housing, and in so doing, are moved over an inlet port in the housing to draw fluid into the chamber and then over an outlet port in the housing to discharge the fluid. The hydraulic pump further comprises a roller that is mounted in a longitudinally extending pocket of the housing. The roller is positioned after the outlet port in a direction of the rotor's rotation and is arranged to follow the outer surface of the rotor and seal against each recess as it is drawn past the roller, thereby directing fluid from the chamber into the outlet port.

9 Claims, 8 Drawing Sheets

(52) U.S. Cl.
CPC ..... *F04C 11/008* (2013.01); *F04C 15/008* (2013.01); *F04C 15/06* (2013.01); *F04C 2230/60* (2013.01); *F04C 2240/40* (2013.01); *F04C 2240/50* (2013.01)

(58) Field of Classification Search
CPC .. F04C 15/0065; F04C 2/3564; F04C 2/3566; F04C 11/008; F04C 15/008; F04C 15/06; F04C 2230/60; F04C 2240/40; F04C 2240/50; F04C 15/0096
USPC ..... 417/353, 354; 310/156.01, 60 R, 62, 63, 310/67 R, 261.1; 418/255, 221, 249, 248
See application file for complete search history.

(56) References Cited

U.S. PATENT DOCUMENTS 3,416,457 A * 12/1968 Hare ..... F01C 1/3566 418/248
4,111,618 A * 9/1978 Thibault ..... F01C 1/3566 180/308
4,373,878 A * 2/1983 Sauvaget ..... F01C 21/0809 418/177
4,486,150 A 12/1984 Davis
5,580,227 A * 12/1996 Rappenhoner ..... F04C 2/3566 222/291
2004/0040435 A1* 3/2004 Shrive ..... F04B 1/0439 91/491
2012/0034122 A1* 2/2012 Hayes-Pankhurst ..... F01C 5/04 418/129
2015/0204327 A1* 7/2015 Pribanic ..... H02K 7/14 417/420

FOREIGN PATENT DOCUMENTS

FR 2125644 A5 9/1972
GB 1404705 A 9/1975
GB 1554156 A 10/1979
WO 9313296 A1 7/1993

* cited by examiner

HYDRAULIC PUMP HAVING A CYLINDRICAL ROLLER WITHIN A HOUSING HAVING AN INLET GALLERY AND AN OUTLET GALLERY FORMED IN A CIRCUMFERENTIAL OUTER SURFACE OF THE HOUSING

FOREIGN PRIORITY

This application claims priority to European Application No. EP 15461547.0 filed Jul. 6, 2015, the entire contents of which is incorporated herein by reference.

TECHNICAL FIELD

The present disclosure relates to a hydraulic pump.

BACKGROUND

Hydraulic pumps are used in a number of systems. In many designs, an electric motor is used to turn a rotor that receives fluid from an inlet, applies pressure to the fluid, and discharges the pressurised fluid through an outlet. A known design of hydraulic pump is a vane pump in which rotating vanes trap a portion of fluid and entrain the fluid past a cam surface on the stator, the cam surface acting to reduce the volume of the chamber as the vanes rotate, thus applying pressure to the fluid before the fluid is discharged through an outlet.

While various designs of hydraulic pump exist, there is a drive to reduce the complexity and manufacturing difficulty of hydraulic pumps, to meet the requirements of efficiency, flow-rate, weight, complexity of manufacture and maintenance, and cost.

SUMMARY

In accordance with the present disclosure there is provided a hydraulic pump comprising a rotor provided for rotation about a longitudinal axis within a housing, the pump comprising a plurality of chambers for pumping a fluid, the chambers being provided by longitudinally extending recesses in a circumferential outer surface of the rotor, the recesses being moved across a circumferential inner surface of the housing during rotation of the rotor, and in so doing, being moved over an inlet port in the housing to draw fluid into the chamber and then over an outlet port in the housing to discharge the fluid, wherein the hydraulic pump further comprises a roller that is mounted in a longitudinally extending pocket of the housing, the roller being positioned after the outlet port in a direction of the rotor's rotation, the roller further being arranged to follow the outer surface of the rotor and seal against each recess as it is drawn past the roller, thereby directing fluid from the chamber into the outlet port.

The hydraulic pump may be driven directly by an integral motor.

In one embodiment, the rotor may comprise a plurality of magnets which are able to generate a magnetic field extending from an inner circumferential surface of the rotor. The hydraulic pump may be provided with a stator comprising a winding that is arranged internally of the rotor. Through this the rotor may be driven within the housing by electromagnetic fields generated within the winding interacting with the magnetic fields of the magnets of the rotor.

The magnets on the rotor and the winding on the stator may be configured as a three-phase motor to provide rotational drive to the rotor. This provides simplicity and may result in low maintenance for the hydraulic pump.

The roller is accommodated within an axially extending pocket positioned in the housing after the outlet port in the direction of the rotor's rotation. The pocket may comprise a radially extending wall which the roller is able to seal against during operation of the pump. The roller may be arranged in the housing to reciprocate in a radial direction of the hydraulic pump as the rotor is rotated.

The pocket may be configured so that, during operation of the pump, hydrostatic pressure in the fluid in an outlet channel extending from the outlet port, urges the roller to seal against both the rotor and the housing. In this way, sealing can be provided in a circumferential direction.

Hydraulic pressure in the fluid may be sufficient to urge the roller against the side of the pocket to provide a seal. A spring may be provided to bias or to further bias the roller toward the outer surface of the rotor. In one embodiment a spring is provided at each end of the roller.

One or more rollers may be arranged, around the rotor within pockets of the housing. In one embodiment there are four rollers. Other arrangements with other numbers of rollers, for example, three or more than four rollers are also envisaged. Generally, the number of rollers and their spacing should be chosen to provide the lowest pressure pulsation possible. While the schematic figures show the rollers as relatively evenly spaced components, in practice, having the rollers more unevenly spaced helps to reduce pressure pulsation.

The longitudinally extending recesses in the circumferential surface of the rotor may define a first curved surface for the chamber. A second curved surface of the chamber may be provided by the circumferential inner surface of the housing. In one embodiment the longitudinally extending recesses in the circumferential surface of the rotor are arcuate in cross-section. This allows the recesses to be formed easily by machining the circumferential outer surface of the rotor with a rotary tool, for example, a tool having a rotary abrasive surface.

Viewed from another aspect, the present disclosure provides a hydraulic pump comprising a rotor provided for rotation about a longitudinal axis within a housing, the pump comprising a plurality of chambers for pumping a fluid, the chambers being provided by longitudinally extending recesses in a circumferential outer surface of the rotor, the recesses being moved across a circumferential inner surface of the housing during rotation of the rotor, and in so doing, being moved over an inlet port in the housing to draw fluid into the chamber and then over an outlet port in the housing to discharge the fluid, wherein the longitudinally extending recesses in the circumferential surface of the rotor are arcuate in cross-section.

The longitudinally extending recesses in the circumferential surface of the rotor may be relatively shallow compared to their extent in a circumferential direction of the rotor. Thus each recess may extend a circumferential distance which is more than five times its radial depth. In some arrangements each recess may extend a circumferential distance which is more than eight times its radial depth.

The angle of incidence for the surface of the roller as it rolls across the surface of the recess may be always less than 30°, to allow the roller to follow the surface of the rotor at all times. In some embodiments the angle of incidence may be less than 25°, or even less than 22°.

The hydraulic pump, when viewed axially, may comprise a plurality of groups of an inlet port followed by an outlet port and an associated roller. The groups may be arranged sequentially around the circumferential inner surface of the housing in the direction of rotation of the rotor, so that each recess/chamber of the rotor is drawn past each group in turn during a full rotation of the rotor. There may be three or more groups during a full rotation of the rotor. In one embodiment there are four groups that each recess is drawn past during a full rotation of the rotor. This multiplicity of chambers operating to pump fluid simultaneously or generally simultaneously assists the overall performance and efficiency of the hydraulic pump.

The inlet ports may be in fluid communication with each other via an inlet gallery comprising a plurality of radially extending inlet channels which are linked by an inlet ring extending circumferentially around the housing.

Similarly, the outlet ports may be in fluid communication with each other via an outlet gallery comprising a plurality of radially extending outlet channels which are linked by an outlet ring extending circumferentially around the housing.

For each group of inlet ports and outlet ports, fluid may be fed in to a respective chamber from a plurality of radially extending inlet channels arranged at different axial levels, and fluid may be discharged from the chamber through a plurality of radially extending outlet channels arranged at different axial levels to each other and the inlet channels. The different axial levels of inlet channels may be interleaved between spaced apart axial levels of outlet channels.

In some embodiments there is an even number of axial levels of inlet channels and an odd number of axial levels of outlet channels. In one example there are two axial levels of inlet channels and three axial levels of outlet channels, but other combinations and arrangements of inlet channels and outlet channels are also envisaged. This alternating axial structure can help to balance the forces exerted on the rotor.

The inlet gallery may further comprise an axially extending inlet pipe, and the outlet gallery may further comprise an axially extending outlet pipe. The pipes may feed fluid to and discharge from the different axial levels of the respective inlet and outlet galleries. The inlet pipe and the outlet pipe may extend into the housing from opposite directions and through respective radially extending inlet and outlet channels.

The circumferentially extending inlet ring(s) and/or circumferentially extending outlet ring(s) may each comprise a groove formed in a circumferential outer surface of the housing. The grooves may be closed off by the inside of a tubular case fitted over the circumferential outer surface of the housing. This arrangement simplifies manufacture and the rings help to maintain a common pressure within the respective inlet channels or the outlet channels.

Accordingly, when viewed from a further aspect, the present disclosure can be seen to provide a hydraulic pump comprising a rotor provided for rotation about a longitudinal axis within a housing, the pump comprising a plurality of chambers for pumping a fluid, the chambers being provided by longitudinally extending recesses in a circumferential outer surface of the rotor, the recesses being moved across a circumferential inner surface of the housing during rotation of the rotor, and in so doing, being moved over an inlet port in the housing to draw fluid into the chamber and then over an outlet port in the housing to discharge the fluid, wherein the housing comprises a tubular body which is formed with an inlet gallery and an outlet gallery for directing fluid through the housing, the housing comprising a plurality of inlet channels extending radially from a circumferential outer surface of the housing to the inlet ports on the circumferential inner surface of the housing, and a plurality of outlet channels extending radially from the circumferential outer surface of the housing to the outlet ports on the circumferential inner surface of the housing, the inlet channels and the outlet channels being arranged on different axial levels, and wherein an inlet ring extends around the circumferential outer surface of the housing and communicates with each of the inlet channels for a given axial level, and an outlet ring extends around the circumferential outer surface of the housing and communicates with each of the outlet channels at a different axial level, the inlet ring and outlet ring each being provided by a groove that has been formed in the circumferential outer surface of the housing and enclosed by a circumferential inner surface of a case which has been fitted over the housing.

The stator may comprise a hollow cylindrical central portion that is left empty. This may assist in cooling the motor of the pump and for providing ease of access to the winding for electrical connections.

When viewed from a further aspect, the present disclosure can be seen to provide a hydraulic pump comprising: a rotor provided for rotation about a longitudinal axis within a housing, a plurality of magnets which are able to generate a magnetic field extending from an inner circumferential surface of the rotor; and a stator comprising a winding that is arranged internally of the rotor, whereby the rotor may be driven within the housing by electromagnetic fields generated within the winding interacting with the magnetic fields of the magnets of the rotor. The hydraulic pump may also comprise a plurality of chambers for pumping a fluid, the chambers being provided by longitudinally extending recesses in a circumferential outer surface of the rotor. These recesses may be moved across a circumferential inner surface of the housing during rotation of the rotor, and in so doing, may be moved over an inlet port in the housing to draw fluid into the chamber and then over an outlet port in the housing to discharge the fluid.

The present disclosure may also be seen to provide a method of making a hydraulic pump comprising: fabricating a housing having a circumferential outer surface and a circumferential inner surface, the inner surface being adapted to receive a rotor for pumping a fluid, the fabricating including forming, in the inner surface of the housing, an inlet port and an outlet port for a fluid and a longitudinally extending pocket for receiving a roller, the pocket being positioned after the outlet port in the intended direction of the rotor's rotation; fabricating a rotor comprising forming a plurality of longitudinally extending recesses in a circumferential outer surface of the rotor; introducing the rotor within the housing and arranging it for rotation with respect to the housing, wherein the recesses in the rotor are enclosed by the circumferential inner surface of the housing to provide a plurality of chambers for conveying fluid between an inlet port and an outlet port of the housing; and introducing a roller into the pocket of the housing and arranging it so as to follow the outer surface of the rotor and seal against each recess as the rotor is drawn past the roller.

The plurality of longitudinally extending recesses in the outer surface of the rotor may be formed by machining the circumferential outer surface of the rotor using a rotary tool, e.g., one which rotates about an axis parallel to or generally parallel to that of the rotor. In this way the outer surface of the rotor can be machined easily to provide the recesses which form the chambers. In some embodiments the tool may have a rotary abrasive surface, which is used to remove a longitudinally extending, arcuate portion of material from the circumferential outer surface of the rotor.

The method of making the hydraulic pump may further include arranging magnets and a winding to provide an integral motor within the hydraulic pump which can drive the pump directly.

The fabricating of the rotor may include affixing magnets in or to a circumferential inner surface of the rotor. The method may also include making a stator comprising a winding and mounting the stator in the hydraulic pump in a location internal of the circumferential inner surface of the rotor. The stator may be arranged to generate an electromagnetic field in order to provide rotational drive for the rotor. The stator may comprise a three-phase motor.

Radial holes may be drilled through the housing to provide the inlet port(s) and the outlet port(s) for the fluid. The radially extending holes may provide inlet channels and outlet channels respectively. The inlet channels and the outlet channels may form part of an inlet gallery and an outlet gallery respectively.

In some embodiments a plurality of radial holes may be drilled through the housing to provide groups of inlet ports and outlet ports for the fluid. In addition, the groups of inlet ports may be linked together and the groups of outlet ports may be linked together by respective inlet and outlet ring-shaped passages which extend around the circumferential outer surface of the housing. The inlet and outlet rings may be formed by machining circumferentially extending grooves in the circumferential outer surface of the housing and enclosing the grooves by fitting a case over the housing. Thus the method of making a hydraulic pump may include fitting a tubular case over the circumferential outer surface of the housing to enclose the outer extremities of the inlet and outlet galleries.

The method may also comprise making an end plate for each end of the pump. One end plate may have an inlet orifice formed therein for feeding fluid into the pump. The other end plate may have an outlet orifice formed therein for discharging fluid from the pump. The method of making the hydraulic pump may include securing the end plates to the respective ends of the pump. In some embodiments the securing of the end plates may be performed using screws which are driven into the housing.

Hydraulic pressure in the fluid may be sufficient to urge the roller against the outer surface of the rotor to form a seal. In this way, sealing can be provided in a radial direction. The method of making a hydraulic pump may also include inserting a spring into the pump to urge the roller against the outer surface of the rotor.

The roller may be formed by mounting a sleeve on a central axle. The sleeve may be rotatable about the axle through the provision of bearings on the axle which are in contact with the sleeve. The bearings may be axially extending needle bearings. In some embodiments, for example, where pre-tighten springs have not been incorporated, the provision of a central axle and bearings may not be required. Formations in the housing may be provided to guide the reciprocating movement of the roller within the pocket.

BRIEF DESCRIPTION OF DRAWINGS

Certain preferred embodiments of the present invention will now be described in greater detail by way of example only and with reference to the accompanying drawings, in which.

DETAILED DESCRIPTION

Figure 1:
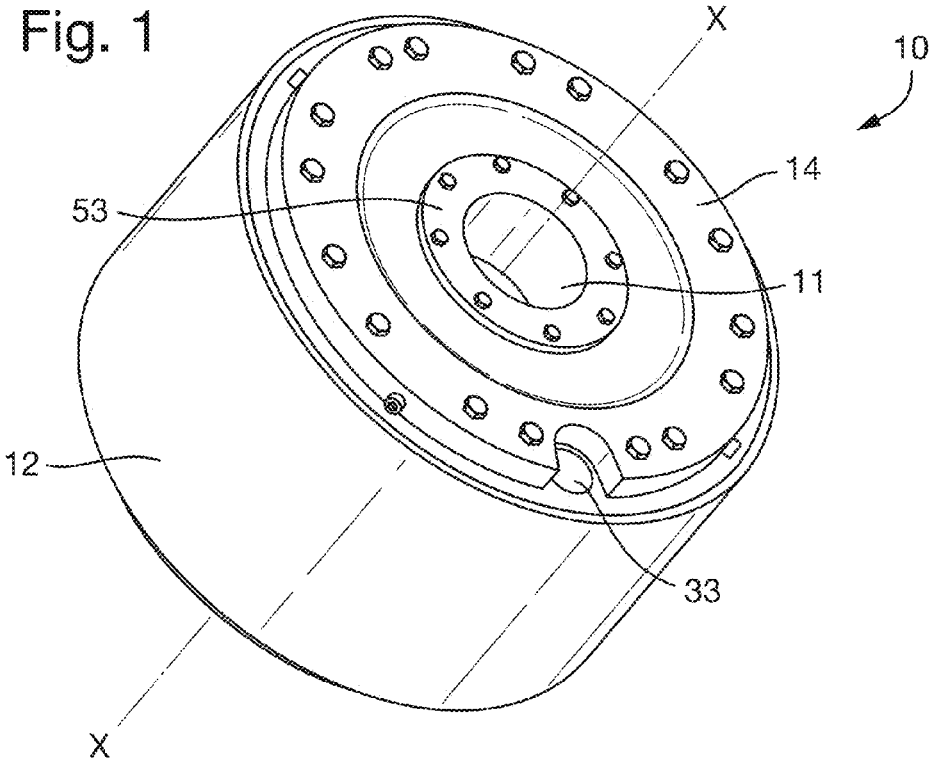
FIG. 1 shows a perspective view of an exemplary hydraulic pump.
Figure 2:
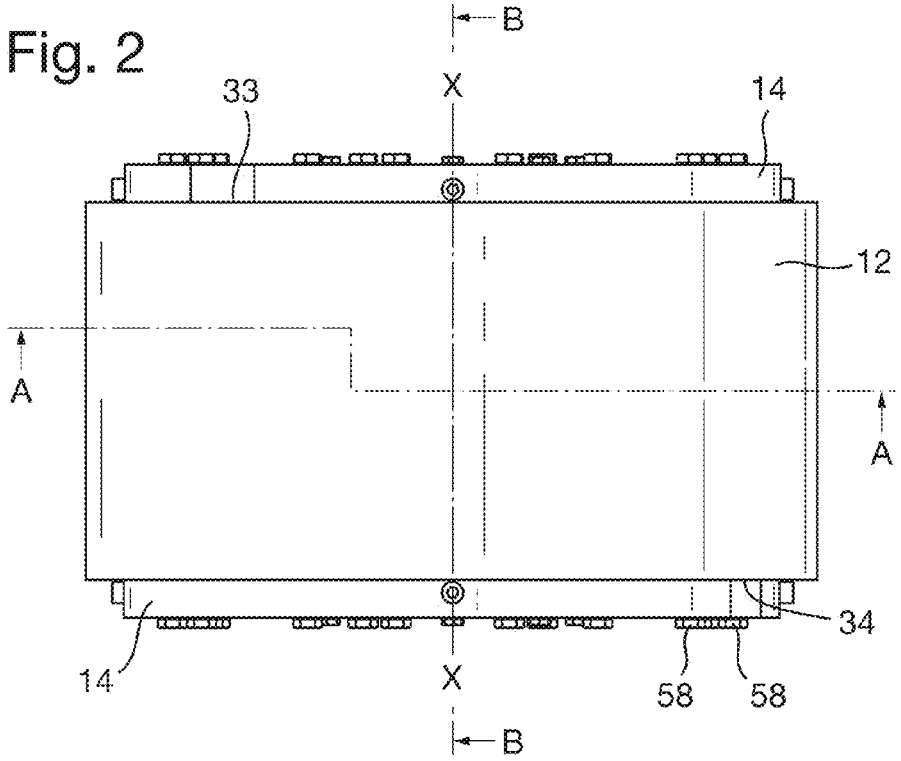
FIG. 2 shows a side view of the hydraulic pump, indicating the sections shown in FIGS. 3 and 4.
Figure 3:
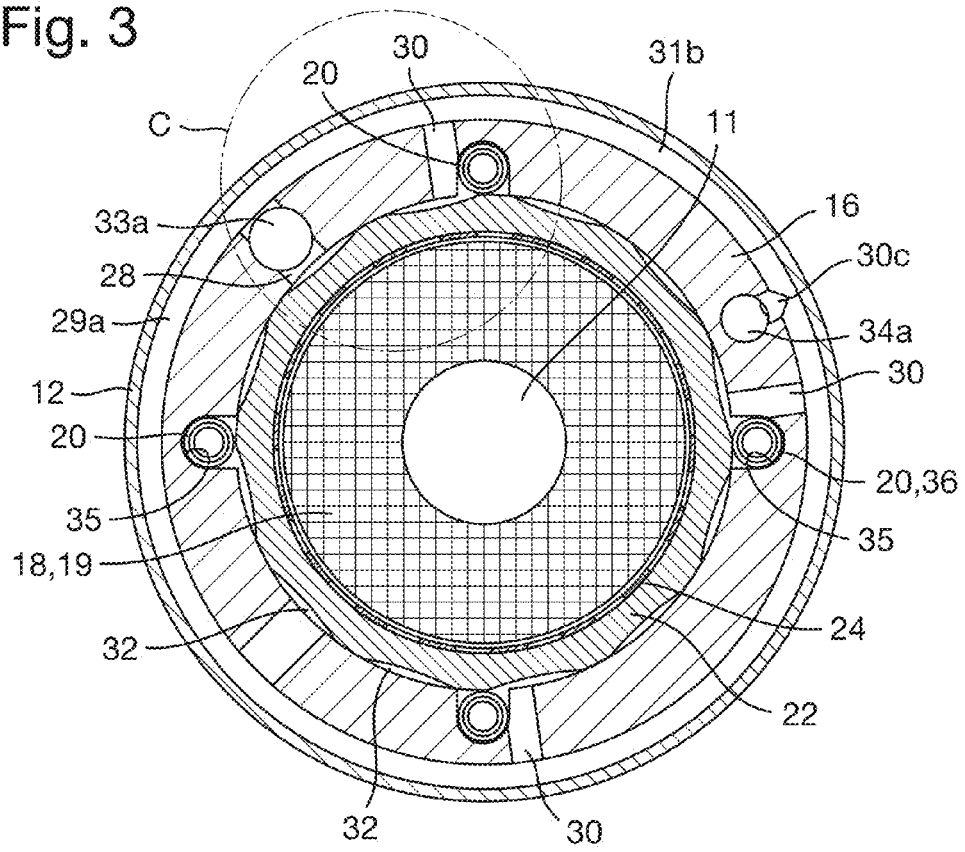
FIG. 3 a cross-sectional plan view across line A-A (looking in the direction of the arrows in FIG. 2) of the hydraulic pump.
Figure 4:
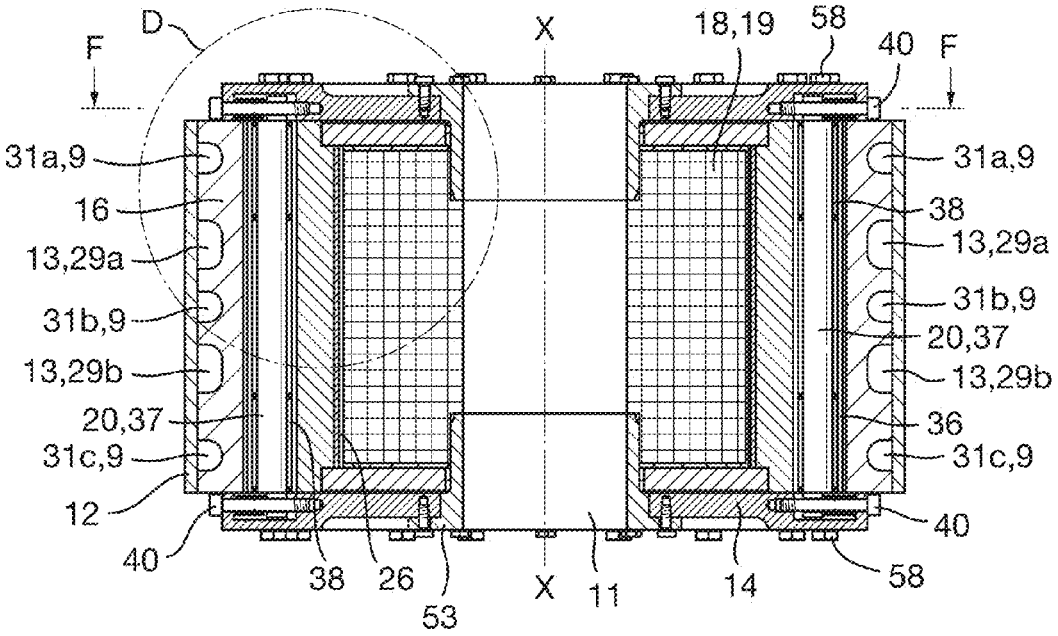
FIG. 4 shows a cross-sectional side view across line B-B (looking in the direction of the arrows in FIG. 2) of the hydraulic pump.

FIG. 1 shows a perspective view of an exemplary hydraulic pump 10 which comprises an exterior of a tubular case 12 capped at each end by an end plate 14. Inside the case 12, as shown in the cross-sectional views of FIGS. 3 and 4, is a tubular housing 16, which defines an interior region of the pump 10. In the middle of the pump 10, fixed in relation to the housing 16, is a winding 18 provided on a stator 19.

The cylindrically-shaped hydraulic pump 10 comprises a central axis X-X. References herein to longitudinal, axial and radial directions, unless stated otherwise, are references to longitudinal, axial and radial directions with respect to this axis X-X.

In addition to these fixed components, mounted within the housing 16 are a plurality of rollers 20 (four in the embodiment shown). These are biased towards a rotor 22, which is able to rotate within the housing 16 about the stator 19. A plurality of magnets 24 may be provided in the rotor 22 for electromagnetic engagement with an electric field generated by the winding 18. The winding 18 may be wound around the stator 19 in the manner shown in FIG. 11 and the winding may be powered by a three-phase power supply. The magnetic field generated by one of the phases is depicted in FIG. 12.

Beneath the surface of the case 12 and within the housing 16, there is a gallery 13 of inlet channels 28 and a gallery 9 of outlet channels 30 to feed the hydraulic fluid through the pump 10. A series of chambers 32 are provided in the rotor 22 to draw fluid from the inlet channels 28 via inlet ports **28*b*, and discharge it into the outlet channels 30 via outlet ports 30*a***, in order to pump fluid through the device.

The hydraulic pump 10 may include a motor to drive the pumping parts (the magnets 24 may interact with the electric field generated by the winding 18 to drive the rotor 22 within the housing 16 directly). This embodiment of electric motor for powering the hydraulic pump 10 will be described below. However it is envisaged that a brushless direct current motor (BLDC) or a permanent magnet synchronous motor (PMSM) motor may be used instead, and other forms of motor may be possible.

In the direct drive motor embodiment illustrated in the figures (e.g. see FIG. 3), the stator 19 may form an annulus with the winding 18 wrapping around the stator 19 in the usual manner for an electric motor. The stator 19 may be coaxial with the case 12 and may be affixed to it via the end plate 14; the stator 19 cannot rotate relative to the case 12. The winding 18 may be wound on or otherwise affixed to the stator 19. A central cylindrical region 11 inside the winding 18 may be left hollow, for example to provide cooling for the winding 18 and/or to provide access for electrical connections to the winding.

The term "winding" used herein is intended to refer collectively to the loops of wire provided on the stator 19 and may cover any number of turns of wire provided on the stator 19, e.g. as represented by the crosshatched region shown in FIGS. 3 and 4. In embodiments, the winding 18 may comprise a three-phase winding as described below and illustrated in FIG. 12.

The rotor 22 may be of a generally tubular shape and may be able to rotate coaxially with respect to the stator 19 and housing 16 in a usual manner of an electric motor.

The rotor 22 may have permanent magnets 24 affixed to an inner surface 22*a*, facing the winding 18. Each magnet 24 may be in the form of a strip of magnetic material (for example, neodymium magnet strips made from an alloy of neodymium, iron, and boron) extending along most or all of the axial extent of the rotor 22. Each magnet 24 may be oriented such that one pole faces radially inward toward the stator 19, the magnets 24 alternating in polarity from one to the next.

Each magnet 24 may be curved to match the contours of the inner surface 22*a* of the rotor 22. An annular air gap 26 (see FIG. 4) may be left between the inner surface of the magnets 24 and the outer surface of the winding 18 to allow the parts to pass without contact.

The inner surface 16*a* of the housing 16 may form a generally smooth, annular shape around the rotor 22. The outer surface 22*b* of the rotor 22, by contrast, may be of varying diameter in a circumferential direction.

Figure 5:
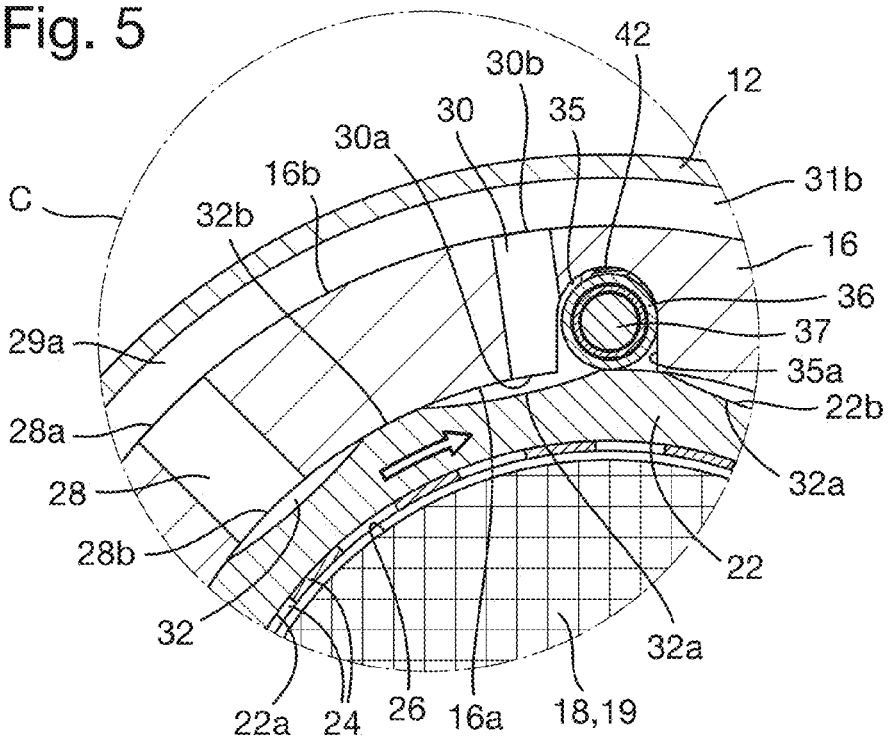
FIG. 5 shows an enlarged view of region C as marked on FIG. 3.

As shown in greater detail in FIG. 5, the rotor 22 may have a plurality of recesses 32 formed in its outer surface 22*b*. In addition to providing chambers 32 for the hydraulic fluid, these recesses 32 and the lands between them making up the remainder of the outer surface 22*b* define a profiled surface of a cam for the rollers 20 to follow.

In the embodiment shown, there are twelve longitudinally extending, arcuate recesses 32 provided in the circumferential surface of the rotor 22. The recesses (chambers) 32 may each have the same, continuous, internal radius of curvature and extend the same circumferential distance around the outer surface of the rotor. The bottom 32*a* of each chamber 32 may extend to a common base circle of the cam. In this way, the chambers 32 may have equal volume.

Between adjacent chambers 32, the outer surface 22*b* of the rotor 22 may have strips or lands 32*b* of constant diameter providing a dwell region where the rollers 20 are pushed back fully for a time into respective pockets 35 in the housing 16 against a biasing force.

However, while a rotor 22 having twelve chambers 32 may have certain advantages for the configuration shown where there are four rollers 20 spaced around the rotor 22, the hydraulic pump 10 is not limited to this specific arrangement and these numbers of chambers 32 or rollers 20.

Similarly, while there are advantages for forming the chambers 32 as uniform, arcuate recesses in the rotor 22, which will be briefly discussed below, the rotor 22 may be provided with chambers 32 of a different profile for the rollers 20 to follow.

Further, in some situations, it may be beneficial to provide chambers 32 of different volumes.

To balance loads and minimise vibrations, similar chamber profiles may be arranged opposite each other.

In the embodiments where the chambers 32 are formed as longitudinally extending, arcuate recesses in the outer surface 22*b* of the rotor 22, the cam profile for the rotor 22 may be manufactured easily. For example, it may be formed by providing an initially smooth, cylindrical or tubular body (e.g., produced on a lathe or cut from cylindrical/tubular stock) and then removing material to form the longitudinally extending, arcuate chambers 32, e.g. by machining the outer surface of the rotor 22 with an abrasive drum, a cylindrical file or other suitable cutting tool to form the arcuate recesses 32.

The cam profile for the rotor 22 may therefore comprise a shape formed from the intersection of cylinders, namely the intersection of the cylinder defined by the original circumferential outer surface 22*b* of the rotor 22 and the plurality of cut-out, part-cylinder shapes corresponding to the longitudinally extending, arcuate recesses 32. This provides a simple and inexpensive way to produce the rotor 22.

Alternatively, it would also be possible to form the chambers 32 in the rotor 22 by other means such as by forging, stamping or extrusion. The rotor 22 could also be cast, powder formed or moulded to the desired shape (possibly with machining to final dimensions).

The volume of each chamber 32 is defined by the space enclosed by the inner surface of the recess 32 and the opposing inner surface of the housing 16. Each chamber 32 may have the same volume. These chambers 32 entrain the fluid and pump it from the inlet channels 28 to the outlet channels 30. A thin film of fluid may also be disposed between the housing 16 and the lands 32*b* of the rotor 22 to lubricate relative motion between the two, closely positioned surfaces 16*a*, 22*b*.

The housing 16 contains a plurality of radially extending inlet channels 28 and a plurality of radially extending outlet channels 30. In the embodiment shown, there are four groups of inlet/outlet channels 28, 30, corresponding to the same number of rollers 20. These groups are shown in the figure spaced evenly around the pump 10 and are caused to operate simultaneously, i.e. four chambers 32 will start to be filled at the same time with fluid, and subsequently will then start to be discharged at the same time, during each quarter rotation of the rotor 22. In practice the relative positions of the chambers and groups may be altered slightly with respect to each other, for example, to try to reduce pressure pulsation caused by simultaneous movement.

The circumferential length of the chamber 32 may correspond to about a third of the arcuate distance that the outer surface 22*b* of the rotor 22 moves through between it reaching consecutive inlet channels 28 and/or consecutive outlet channels 30. In this way, the rotor 22 may move through three stages of a stroke, each stage corresponding substantially to the circumferential length of the chamber 32; namely a filling stage, a discharge stage and a sealed stage (where neither filling nor discharging of fluid from the chamber 32 is taking place). The position of the inlet and outlet channels 28, 30 may be such that the filing stage is initiated in one chamber 32 at the same time as a discharge stage is being initiated in a preceding chamber 32. Where there are four rollers 20, like in the embodiment shown, the stages may correspond to twelfths of a complete rotation for example.

Other arrangements may use other quantities of inlet/outlet channels 28, 30 and rollers 20.

In some instances it may be desirable for the chambers 32 to be noticeably out of phase so that one chamber 32 begins to fill at a different time to the next.

Each radially extending inlet channel 28, at a first end 28*a* thereof, may be in fluid communication with a plurality of circumferentially extending inlet rings 29*a*, 29*b* of an inlet gallery 13. Each inlet channel 28 may also extend radially through the housing 16 to a second end 28*b*, which opens to the outer surface 22*b* of the rotor 22 and forms the inlet port 28*b*.

An inlet orifice 33 of the hydraulic pump 10 may be provided to supply fluid to the inlet gallery 13, and through the connections of the inlet gallery 13, supply the plurality of inlet channels 28. The inlet orifice 33 may lead to an axially extending inlet pipe 33*a* which intersects a group of inlet channels 28 at different axial levels to supply the inlet gallery 13 with fluid.

Similarly, each radially extending outlet channel 30 may have a first end 30*a* which is open to the outer surface 22*b* of the rotor 22 and forms the outlet port 30*a*. Each outlet channel 30 may extend through the housing 16 to a second end 30*b*, which opens to one of a plurality of circumferentially extending outlet rings 31*a*, 31*b*, 31*c* of an outlet gallery 9.

An outlet orifice 34 may be provided to discharge fluid from the outlet gallery 9 and thereby discharge fluid from the plurality of outlet channels 30. The outlet orifice 34 may be fed by an axially extending outlet pipe 34*a* which intersects a group of outlet channels 30 or outlet connections 30*c* at different axial levels to receive fluid from the outlet gallery 9.

The inlet orifice 33 may be arranged on an opposite end of the hydraulic pump 10 to the outlet orifice 34, such that the inlet pipe 33*a* and the outlet pipe 34*a* extend axially from opposite ends of the hydraulic pump 10. The inlet orifice 33 and outlet orifice 34 may be at similar radial positions with respect to the axis X-X but arranged at different circumferential positions so that the inlet pipe 33*a* and outlet pipe 34*a* avoid one another. The inlet pipe 33*a* and outlet pipe 34*a* may be formed easily in the housing 16 by drilling holes in an axial direction from each end of the housing 16. The outlet pipe 34*a* may communicate with the rest of the outlet gallery 9 through outlet connections 30*c*.

The inlet channels 28 and the outlet channels 30 may be formed easily in the housing 16 by drilling holes in a radial direction through the housing 16.

The inlet channels 28 and the outlet channels 30 may be positioned at different axial levels within the housing 16. The housing may comprise an even number of levels of inlet channels 28 and an odd number of levels of outlet channels 30. An even number of levels of inlet channels 28 may be interleaved between an odd number of levels of outlet channels 30.

Each level of inlet channels 28 may comprise a circumferential inlet ring 29*a*, 29*b*, which links up all the inlet channels 28 of that level. Each level of outlet channels 30 may comprise a circumferential outlet ring 31*a*, 31*b*, 31*c*, which links up all the outlet channels 30 of that level.

In the embodiment shown, there are two levels of inlet channels 28 interleaved between three layers of outlet channels 30. Thus fluid entering a chamber 32 through one inlet port 28*a* on one level may exit through a plurality of outlet ports 30*a* on adjacent levels.

Each inlet ring 29*a*, 29*b* may be formed by a circumferentially extending groove in the circumferential outer surface 16*b* of the housing 16 which is enclosed by a circumferential inner surface 12*a* of the case 12. Similarly, each outlet ring 31*a*, 31*b*, 31*c* may be formed by a circumferentially extending groove in the circumferential outer surface 16*b* of the housing 16 which is enclosed by a circumferential inner surface 12*a* of the case 12.

This facilitates a straightforward method of manufacture, since the circumferential grooves in the outer surface 16*b* of the housing 16 can be machined easily on a lathe and the case 12 can be placed over the housing 16, with an interference fit or weld, to enclose the grooves and form the inlet/outlet rings 29*a*, 29*b*, 31*a*, 31*b*, 31*c*.

The circumferential grooves of the inlet rings 29*a*, 29*b* may extend a greater extent in the axial direction than the circumferential grooves of the outlet rings 31*a*, 31*b*, 31*c*, e.g. where the number of outlet rings 31*a*, 31*b*, 31*c* is greater than the number of inlet rings 29*a*, 29*b* (in the illustrated embodiment, a ratio of 3 to 2), to generally balance the volumes in the inlet/outlet galleries 13, 9.

The total cross-sectional area of the inlet rings 29*a*, 29*b* may be not quite equal to the total cross-sectional area of the outlet rings 31*a*, 31*b*, 31*c*. In other embodiments, the total cross-sectional area of the inlet rings 29*a*, 29*b* may be slightly greater than the total cross-sectional area of the outlet rings 31*a*, 31*b*, 31*c*. The inlets may be larger than the outlets to provide lower fluid velocity, as high velocity combined with low pressure can result in cavitation.

The rollers 20 are situated adjacent the outlet ports 30*a* of a group of outlet channels 30 which are arranged above one another in the axial direction. Each roller 20 is housed within a longitudinally extending pocket 35 in the housing 16. The longitudinally extending pocket 35 is located adjacent the outlet port 30*a* of an outlet channel 30 on a downstream side in the direction of rotation of the rotor 22. Each roller 20 may serve to deflect fluid from a chamber 32 to each group of outlet ports 30*a* simultaneously. The rollers 20 abut and follow the rotor 22, and may be rotated by the rotation of the rotor 22 through friction.

During operation of the pump 10, each roller 20 may be biased toward and maintain contact with the outer surface 22*b* of the rotor 22 as the roller 20 follows the cam profile of the rotor 22. The roller 20 may be able to reciprocate in a radial direction, substantially within the pocket, in order to follow the cam profile. In this way, the roller 20 may provide a reciprocating wall that blocks the path of the fluid which is being carried by the chamber 32 once it has reached the outlet port 30*a* of the outlet channel 30.

Each roller 20 may provide a reciprocating wall that protrudes from the pocket to block the path of the fluid being carried by a single chamber 32 for a group of outlet ports 30*a* at different axial levels simultaneously. Thus fluid can be directed into each of the outlet channels 30 of the group by its associated roller. The dimensions of the recess 32, the roller 20 and the pocket 35, may be selected such that less than 50% of the roller 20 at any one time protrudes from the pocket 35. In some embodiments, the depth d of the recess 32 and the radius r of the roller 22 may satisfy the equation: $0.1r<d<0.5r$.

The pocket 35 may provide a radially extending side that the roller 20 can seal against during operation. Thus the roller 20, in addition to contacting the rotor 22, may also maintain contact with the housing 16 on a radially extending side of this pocket 35 that lies downstream of the roller 20 in the direction of rotation of the rotor 22.

Pressure from the fluid in the outlet channel 30 may tend to bias the roller 20 in a direction towards the radially extending side of the pocket 35 and/or towards the outer surface 22*b* of the rotor 22 during operation.

The roller 20 may comprise a tubular sleeve 36 which is free to roll over the outer surface 22*b* of the rotor 22. The sleeve 36 may be mounted for rotation about a central axle 37 extending down the centre of the sleeve 36. The sleeve 36 may extend along the entire axial length of the rotor 22. The axle 37 may be longer and extend beyond the sleeve 36 at each end of the roller 20, to provide mounting points to mount the roller 20 with respect to the housing 16.

Figure 10:
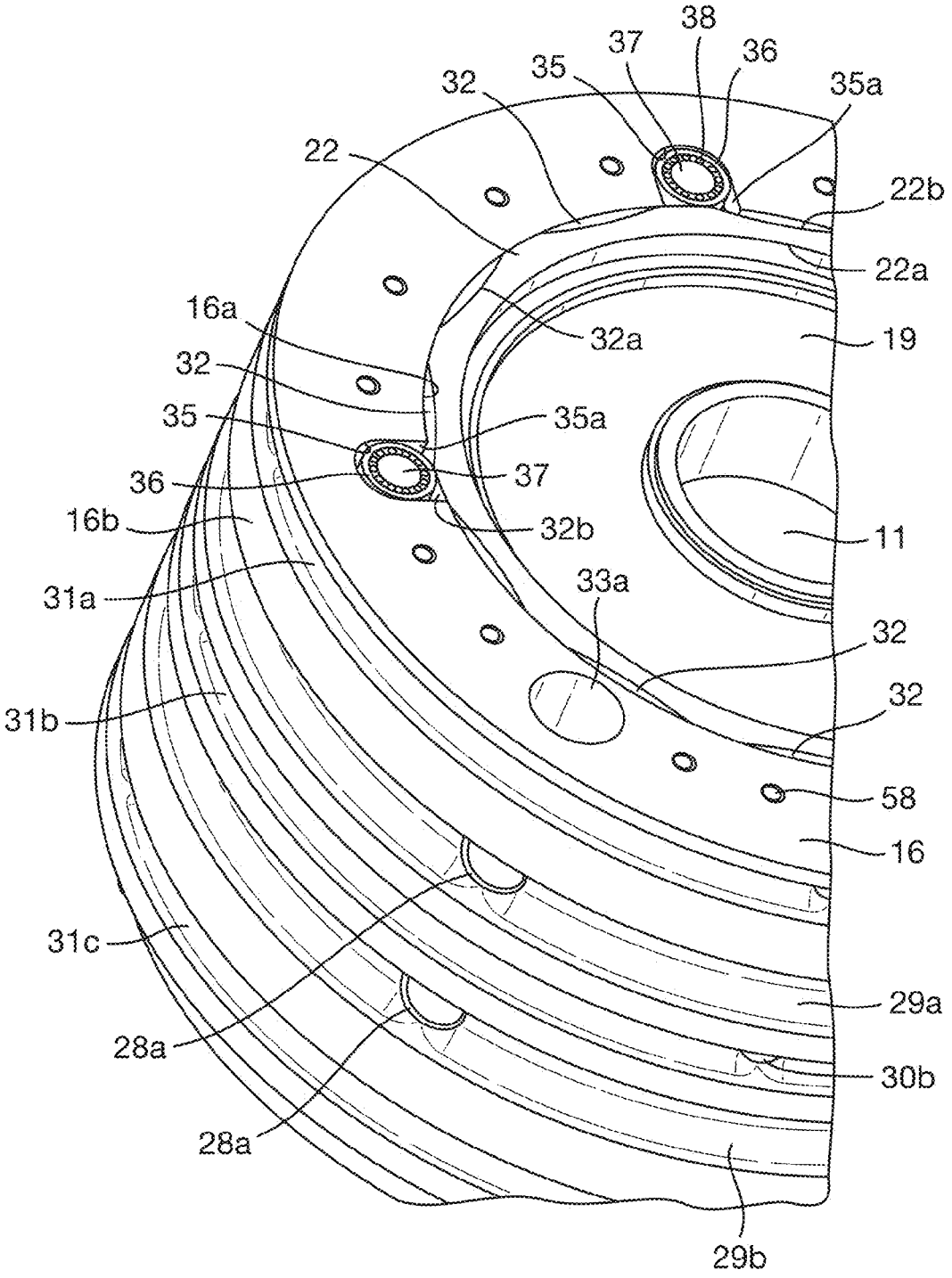
FIG. 10 shows a sectional perspective view of part of the exemplary hydraulic pump with the case removed.

To allow the sleeve 36 to rotate freely around the axle 37, one or more needle bearings 38 may surround the axle 37. The needle bearings 38 may be provided towards each end of the roller 20, as shown in FIG. 10. Needle or other bearings may be positioned at other locations too to support each roller 20. In some instances, bearings may not be required.

A pre-tighten mechanism 40 may be provided at each end of a roller 20 to support the roller 20 for radial, reciprocating movement as it follows the cam profile of the rotor 22. The pre-tighten mechanism 40 may comprise a spring 42, e.g. a helical spring, to urge the roller 20 towards the rotor 22. A pin 44 may extend in a radial direction from the outside of the hydraulic pump 10, through a hole 46 in the end plate 14 and through a hole 48 in the axle 37 to locate the roller 20 with respect to the housing 16.

The axle 37 may be free to reciprocate along the pin 36 (i.e. radially inwardly/outwardly with respect to the pump 10) but may be constrained from rotation about its own axis or from movement along the axis of the pump 10. The spring 42 may be disposed around the pin 36, e.g., extending between a rim 50 of an end plate 14 and a thrust surface 52 of the axle 37 (see FIG. 6). This spring 42 may bias the axle 37 radially inwardly, urging the roller 20 towards the rotor 22.

As mentioned above, during operation, some of the fluid flowing out through the outlet channel 30 may enter the pocket 35 in which the roller 20 sits. This fluid may flow behind the roller 22 (i.e. in a region of the pocket 35 radially outwardly from the roller 22) and its pressure may further help to bias the roller 20 onto the rotor 22.

In some arrangements it may be possible to dispense with springs 42 and instead use the pressure of the fluid to provide the necessary bias to urge the roller 20 against the rotor 22.

To drive the pump 10, the winding 18 on the stator 19 may be energised so as to exert a force on the magnets 24 and thus cause the rotor 22 to rotate relative to the stator 19 and to the housing 16. This rotation of the rotor 22 causes the chambers 32 to be swept, in turn, past the inlet ports 28*b* of the inlet channels 28, causing fluid to become drawn into the chamber 32 by suction. The rotor 22 rotates further, moving the chamber 32 across the inlet ports 28*b* of the inlet channel 28 until it reaches a position where the chamber 32 is no longer in fluid communication with the inlet channel 28. At this point, the volume of entrained fluid is completely enclosed within the chamber 32, between the inner surface of the recess 32 and the inner surface 16*a* of the housing 16. When the chamber 28 containing the fluid comes into fluid communication with the outlet port 30*a* of the outlet channel 30, fluid is then discharged from the chamber 32 by the roller 20 into the outlet channel 30. The fluid is effectively squeezed out of the chamber 32 by the roller 20 as the rotor 22 conveys the chamber 32 past the outlet port 30*a* of the outlet channel 30.

As a result of the seals 20*a*, 20*b* created through the contact of the roller 20 with both the rotor 22 and the radially extending wall 35*a* of the pocket 35, the chamber 32 will continue on its passage through the next stage to the inlet port 28*a* of the next inlet channel 28 carrying a level of vacuum in place of the entrained fluid.

This continuous action of drawing fluid into a chamber 32 and discharging it into an outlet channel 30 as the rotor 22 rotates within the housing 16, forces fluid through the outlet gallery 9 and via the outlet pipe 34*a* to outlet orifice 34. It also draws fluid on the inlet side through the inlet orifice 33, via the inlet pipe 33*a* and the rest of the inlet gallery 13, to deliver the supply of fluid to the plurality of inlet channels 28.

The recesses 32 forming the chambers may be relatively shallow with respect to their circumferential extent along the outer surface 22*b* of the rotor 22. The recesses 32 may extend along a circumferential distance of the rotor 22 which is at least 3 times the depth of the chamber 32. More preferably, the recesses 32 may extend along a circumferential distance of the rotor 22 which is at least 5 times the depth of the chamber 32, and more preferably 8 times the depth of the chamber 32. In this way, the maximum inclination of the cam profile may be less than 30°, preferably less than 25°, and more preferably less than 22° to the radial direction, to help ensure that the roller 20 is able to follow the recessed surface of the chamber 32 and the transition to the lands 32*b* smoothly. The axial extent of the chambers 32 and the significant number of chambers cooperate to allow an adequate volume of fluid to be discharged for a given rotation of the hydraulic pump 10.

In the illustrated embodiment, the stator 18, rotor 22, housing 16, and case 12 are all nested coaxially with one another. The stator 18, housing 16, and case 12 are all held coaxial (and fixed) by the end plate 14. The rotor 22 is held coaxial with the housing 16 by the abutments on the rotor 22. This maintains an air gap 26 between the winding 19 and the rotor 22. Relative movement of the rotor 22 and housing 16 may be lubricated by the fluid. Thus there are no bearings (e.g. ball bearings, thrust bearings etc.) required to maintain the necessary coaxial alignment of the main components of the hydraulic pump 10.

Annular discs 56 may be attached to either end of the rotor 22. These discs 56 extend radially inward beyond the axial ends of the winding 18, thus covering the axial ends of the winding 18. The annular discs 56 may be connected to the rotor 22 by a weld, or by adhesive, or by an interference fit with the rotor 22. A releasable connection, such as an interference fit, is preferred if internal components, such as the winding 18 or rotor 22, may require servicing during the lifetime of the hydraulic pump 10.

The inner diameter of each annular disc 56 is slightly narrower than an outer diameter of an end plate 14 of the hydraulic pump 10. An inner end cap 53 may be fixed at each end plate 14 and may be in the shape of a flanged bushing, with the main cylinder of the bushing 53*a* extending coaxially with the axis of the pump 10. Each inner end cap 53 is attached to one of the annular end plates 14 overlapping an inner diameter edge of the end plate 14, e.g., with a series of screws 57. Towards an outer diameter edge of the end plate 14, the end plate 14 attaches to the housing 16. The end plate 14 may be attached to the housing by screws 58 or by weld or by any other suitable manner. The end cap 56 may be further attached to the winding 18 or to the stator 19 so as to prevent rotation of the stator 19 and winding 18 relative to the housing 16.

Figure 6:
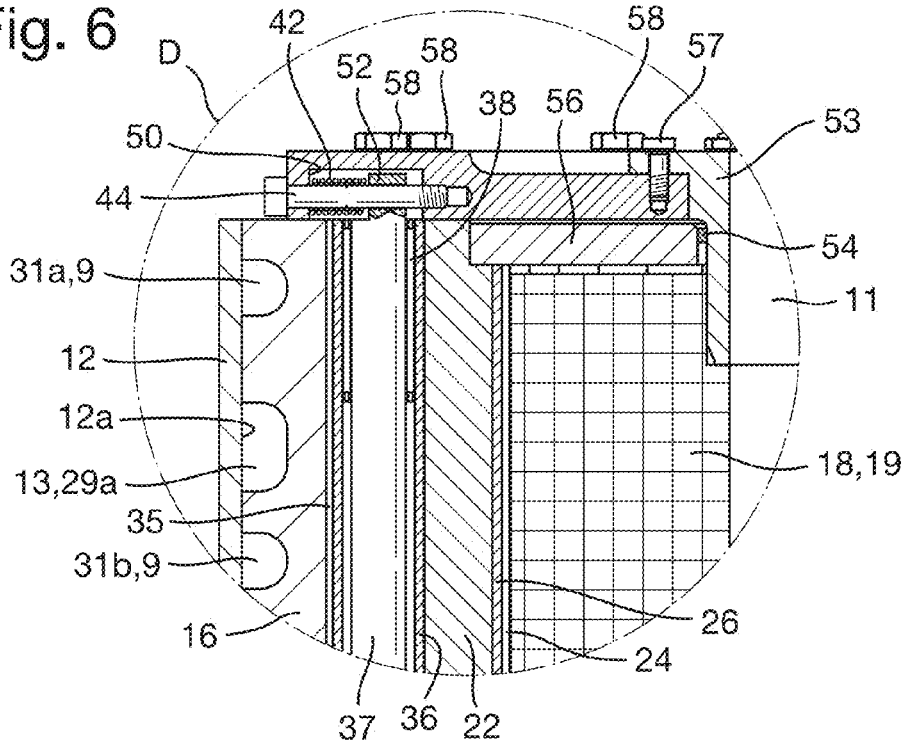
FIG. 6 shows an enlarged view of region D as marked on FIG. 4.
Figure 7:
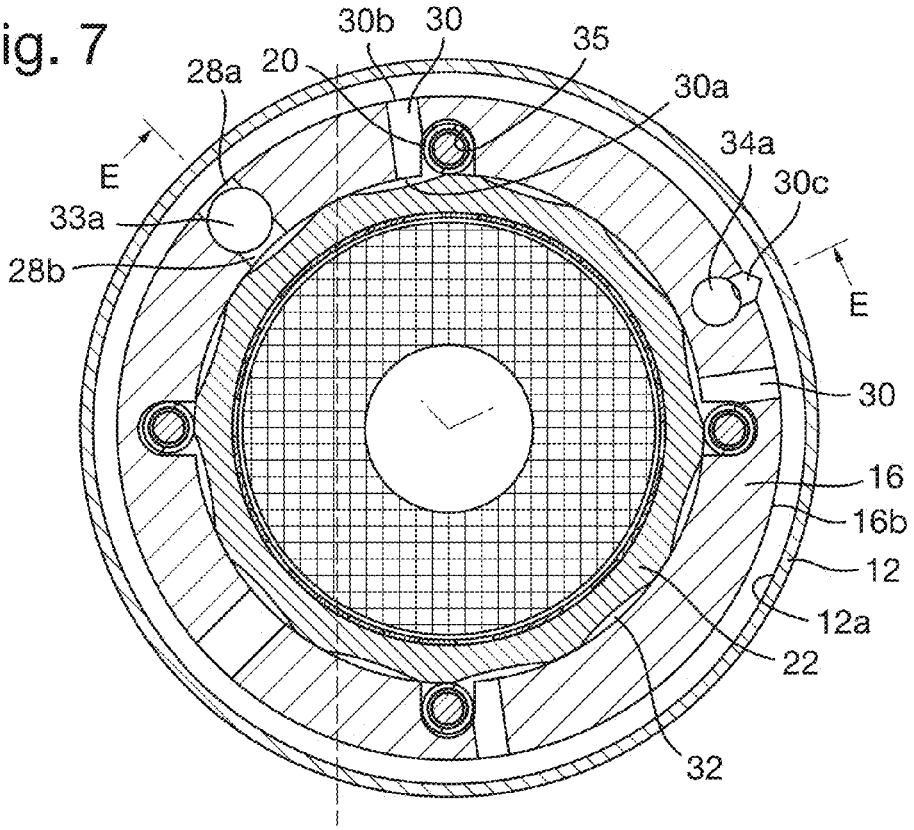
FIG. 7 shows another view of FIG. 3 showing section E-E passing through the inlet and outlet pipes.
Figure 8:
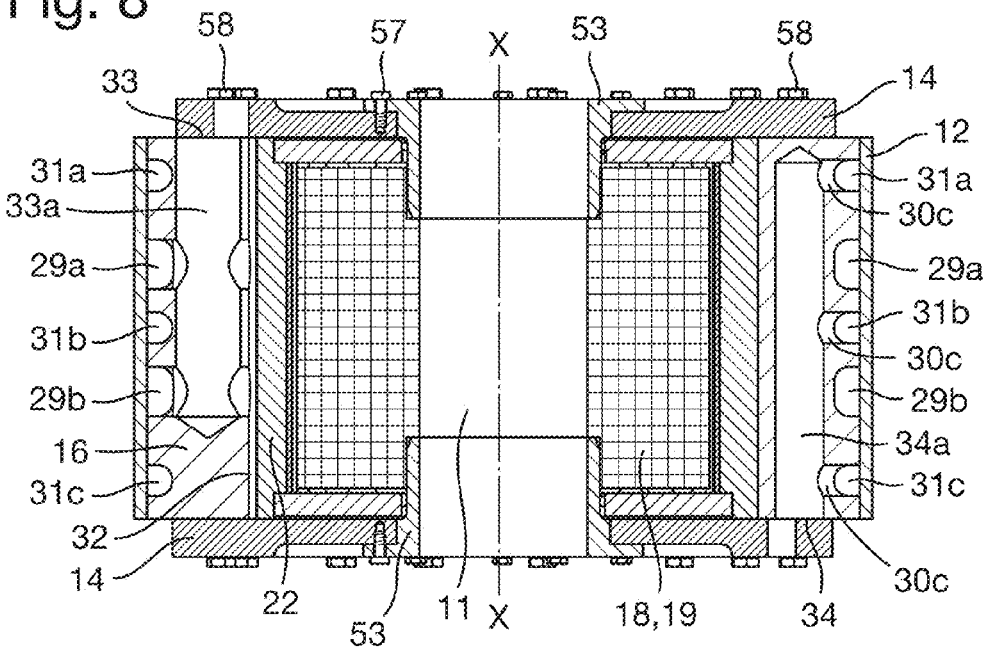
FIG. 8 shows a cross-sectional view along section E-E (looking in the direction of the arrows in FIG. 7), intersecting the inlet and outlet pipes.
Figure 9:
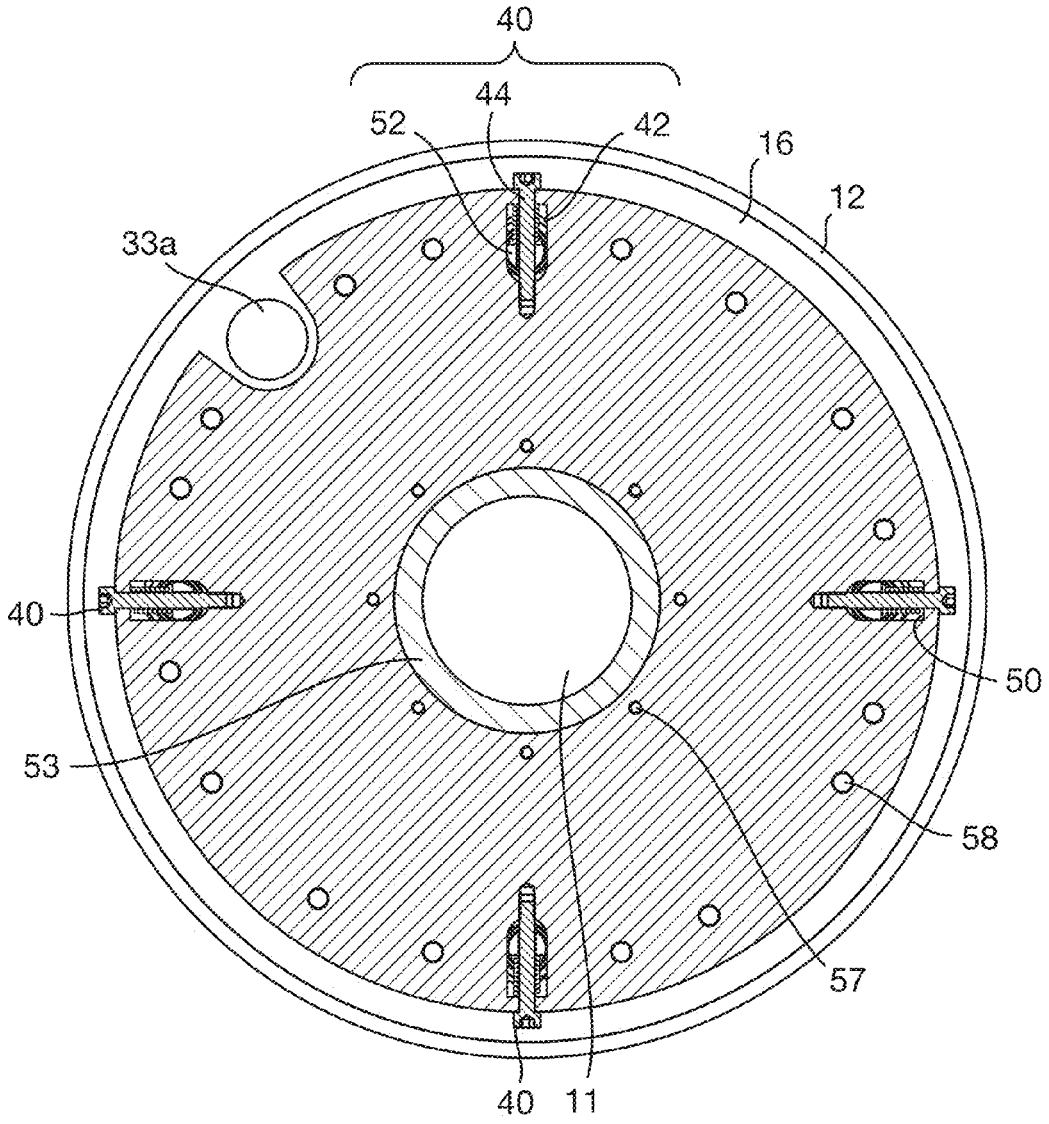
FIG. 9 shows a cross-section across F-F (in the direction of the arrows in FIG. 4), showing details of a pre-tighten mechanism.

As best shown in FIG. 6, the rotor 22 is prevented from translating along its rotational axis X-X by abutting opposed inner surfaces of the end plates 14. The aforementioned annular disc 56 may be disposed between the rotor and the end plate 14. A seal 54 may be disposed on the inner diameter of the annular disc 56, to seal between the annular disc 56 and the end cap 53. The seal 54 thus prevents fluid lubricating the rotor 22 from entering into the air gap 26 formed between the rotor 22 and the stator 19. The air gap may be filled with air or another suitable gas, as suitable for different applications.

Figure 11:
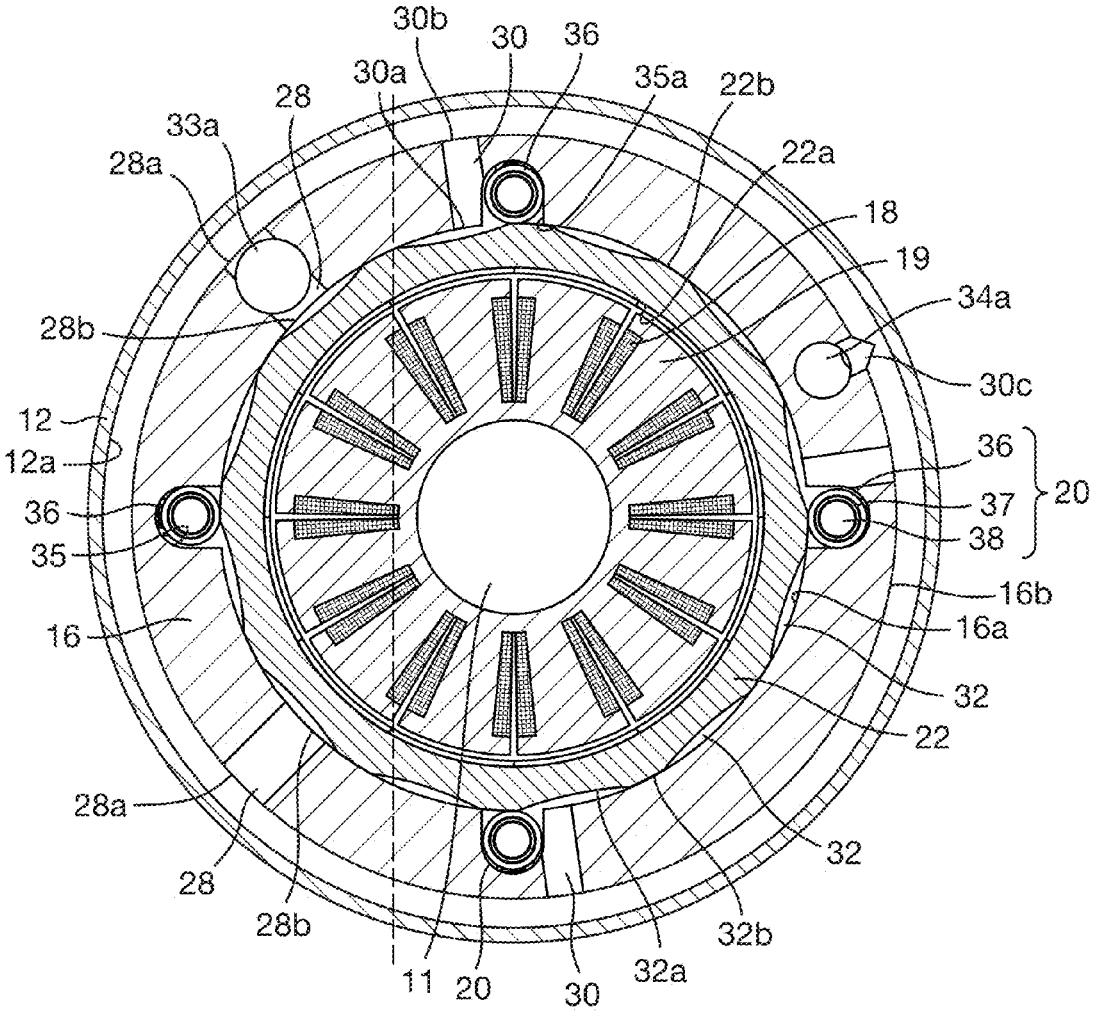
FIG. 11 shows a cross-sectional view across line A-A (FIG. 2), showing details of the electromagnetic windings.
Figure 12:
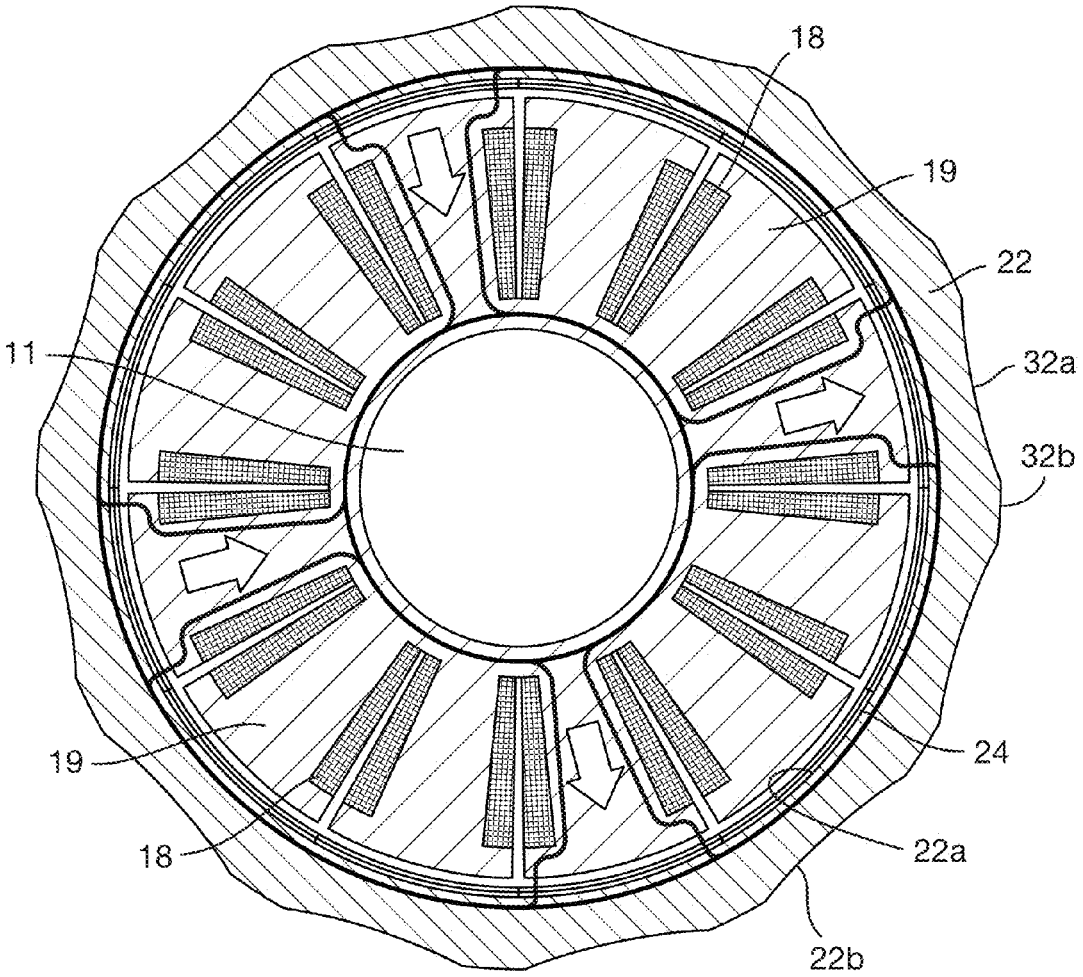
FIG. 12 shows a plan view of the rotor and windings, showing the magnetic flux generated by one phase of the three phase power supply.

As shown in FIG. 11, stator 19 may have multiple windings 18. Each winding 18 may be wrapped around a portion of the stator 19 such that the central axis of the winding 18 points radially outwardly from the central axis X-X of the hydraulic pump 10. Thus, the magnetic field generated by energising a winding 18 extends substantially radially outwardly towards a magnet 24 mounted on the rotor 22.

The winding 18 may comprise a three-phase winding. It may be energised by a three-phase power supply, each phase of the supply powering every third segment of the winding 18 around the stator 19. FIG. 12 shows the magnetic field generated by four winding segments being energised by the same phase. This magnetic field interacts with the magnets 24 mounted on the rotor 22 to cause the rotor 22 to turn. The motor may be brushless, for example, as in the illustrated exemplary embodiment.

The material/s used for pieces in contact with fluids may be chosen according to various design criteria. Further, various parts described above may be coated or left bare. For example, it is preferable for the roller and rotor surface to have good abrasion resistance as these parts have substantial relative motion. The roller and/or rotor may be coated to provide corrosion resistance, if the working fluid is corrosive etc.

The invention claimed is:

1. A hydraulic pump comprising: a rotor provided for rotation about a longitudinal axis within a housing, the pump comprising a plurality of chambers for pumping a fluid, the chambers being provided by longitudinally extending recesses in a circumferential outer surface of the rotor, the recesses being moved across a circumferential inner surface of the housing during rotation of the rotor, and in so doing, being moved over an inlet port in the housing to draw fluid into the chambers and then over an outlet port in the housing to discharge the fluid, wherein the hydraulic pump further comprises a cylindrical roller that is mounted in a longitudinally extending pocket of the housing, the cylindrical roller being positioned after the outlet port in a direction of the rotor's rotation, the cylindrical roller further being arranged to follow the outer surface of the rotor and seal against each recess as it is drawn past the cylindrical roller, thereby directing fluid from the chambers into the outlet port;

a plurality of groups of the inlet port followed by the outlet port and an associated cylindrical roller;

the groups being arranged sequentially around the circumferential inner surface of the housing in the direction of rotation of the rotor, so that each recess of the rotor is drawn past each group in turn during a full rotation of the rotor;

wherein the inlet ports are in fluid communication with each other via an inlet gallery comprising a plurality of radially extending inlet channels which are linked by an inlet ring extending circumferentially around the housing; and/or the outlet ports are in fluid communication with each other via an outlet gallery comprising a plurality of radially extending outlet channels which are linked by an outlet ring extending circumferentially around the housing;

wherein both the inlet gallery and the outlet gallery are formed in the circumferential outer surface of the housing.

2. The hydraulic pump according to claim 1 wherein the rotor comprises:

a plurality of magnets which are able to generate a magnetic field extending from an inner circumferential surface of the rotor; and a stator comprising a winding that is arranged internally of the rotor, whereby the rotor may be driven within the housing by electromagnetic fields generated within the winding interacting with the magnetic field of the magnets of the rotor.

3. The hydraulic pump according to claim 1 wherein the cylindrical roller is arranged in the housing to reciprocate in a radial direction of the hydraulic pump as the rotor is rotated.

4. The hydraulic pump according to claim 1 comprising a spring to bias or to further bias the cylindrical roller toward the outer surface of the rotor.

5. The hydraulic pump according to claim 1 wherein the groups are spaced around the circumferential inner surface of the housing; and the plurality of recesses are spaced around the outer surface of the rotor such that the cylindrical rollers reciprocate radially into and out of the recesses synchronously.

6. A method of making a hydraulic pump, the method comprising:

fabricating a housing having a circumferential outer surface and a circumferential inner surface, the inner surface being adapted to receive a rotor for pumping a fluid, the fabricating including forming, in the inner surface of the housing, an inlet port and an outlet port for a fluid and a longitudinally extending pocket for receiving a cylindrical roller, the pocket being positioned after the outlet port in the intended direction of the rotor's rotation;

fabricating a rotor comprising forming a plurality of longitudinally extending recesses in a circumferential outer surface of the rotor;

introducing the rotor within the housing and arranging it for rotation with respect to the housing, wherein the recesses in the rotor are enclosed by the circumferential inner surface of the housing to provide a plurality of chambers for conveying fluid between an inlet port and an outlet port of the housing;

introducing a cylindrical roller into the pocket of the housing and arranging it so as to follow the outer surface of the rotor and seal against each recess as the rotor is drawn past the cylindrical roller;

drilling radial holes through the housing to provide the inlet port and the outlet port for the fluid, the radially extending holes providing inlet channels and outlet channels respectively;

machining a circumferentially extending groove in the circumferential outer surface of the housing to provide an inlet ring which connects inlet channels;

machining a circumferentially extending groove in the circumferential outer surface of the housing to provide an outlet ring which connects outlet channels; and fitting a case over the housing to enclose the grooves.

7. The method of making a hydraulic pump according to claim 6, wherein the plurality of longitudinally extending recesses in the outer surface of the rotor are formed by machining the circumferential outer surface of the rotor using a rotary tool having a radius corresponding to the radius of the recess.

8. The method of making a hydraulic pump according to claim 6, comprising making a stator that comprises a winding; and mounting the stator in the hydraulic pump in a location internal of the circumferential inner surface of the rotor, the stator being arranged to generate an electromagnetic field in order to provide rotational drive for the rotor.

9. The method of making a hydraulic pump according to claim 6 comprising:

making an end plate for each end of the hydraulic pump wherein a first of the end plates has an inlet orifice formed therein for feeding fluid into the pump; and a second of the end plates has an outlet orifice formed therein for discharging fluid from the pump; and securing the end plates to the respective ends of the hydraulic pump.

* * * * *